United States Patent [19]

Monsheimer et al.

[11] 3,939,040

[45] Feb. 17, 1976

[54] ENZYMATIC BATING METHOD

[75] Inventors: Rolf Monsheimer, Darmstadt-Eberstadt; Ernst Pfleiderer, Darmstadt-Arheilgen, both of Germany

[73] Assignee: Rohm GmbH, Darmstadt, Germany

[22] Filed: Apr. 23, 1974

[21] Appl. No.: 463,392

[30] Foreign Application Priority Data

Apr. 28, 1973 Germany ..... 2321629

[52] U.S. Cl. ..... 195/6; 8/94.16

[51] Int. Cl.[2] ..... C14C 1/06

[58] Field of Search ..... 195/5, 6; 8/94.1 A, 94.16, 8/94.18

[56] References Cited

UNITED STATES PATENTS

| | | | |
|---|---|---|---|
| 2,041,731 | 5/1936 | Wallerstein et al. | 195/6 |
| 2,936,265 | 5/1960 | Whitehill et al. | 195/6 |
| 3,429,648 | 2/1969 | Langley | 195/6 |

OTHER PUBLICATIONS

Zimmerman et al. "Handbook of Material Trade Names", p. 414 (1953).

*Primary Examiner*—A. Louis Monacell
*Assistant Examiner*—R. B. Penland
*Attorney, Agent, or Firm*—Curtis, Morris & Safford

[57] ABSTRACT

A method for bating soaked, limed, dehaired hides with an enzyme mixture of (a) a bacterial protease having an optimum efficacy toward hemoglobin at a pH from 10 to 12 and (b) a fungus protease having an optimum efficacy toward casein at a pH greater than 7, or a neutral to weakly alkaline bacterial protease, papain, or trypsin.

2 Claims, No Drawings

ENZYMATIC BATING METHOD

The present invention relates to a method for bating skins and hides with mixtures of certain proteolytic enzymes.

Since the discovery by Dr. Otto Roehm in 1907 of the bating of hides with the aid of a watery extract of the pancreas, which discovery laid the basis for replacement of the dog dung bate — practiced for more than a thousand years — at first by pancreatic enzymes, later by plant enzymes, and finally by enzymes produced by microorganisms, innumerable variations of the enzymatic bating process have been proposed. In the known processes, proteolytic enzymes are used in a weakly acid region as well as in a neutral or weakly alkaline region. In none of the enzymatic bates heretofore proposed, in which great emphasis has been placed on the loosening of scud, can pancreatic trypsin be dispensed with, even though there are doubts concerning the use of this protease — principally isolated from the pancreas glands of swine and cattle — from the point of view of both economy and veterinary medicine. Thus, the supply of pancreatic glands is limited in nature. Their processing for the recovery of technically useful products is not inconsiderably limited by the value of these glands for the production of insulin. Also, many countries, for example Australia, have enacted strong supervisory regulations to protect against virus infections which can be transmitted by pancreatic products. Despite all these difficulties, at least some content of pancreatic trypsin could heretofore not be omitted from any first-rate enzymatic bating agent. Reference should be made in this context to the earliest pertinent German patent publication, DOS 21 13 214 published on Sept. 28, 1972, disclosing a bating process employing an enzyme mixture of papain and pancreatin.

The present invention relates to an enzymatic bating method giving an excellent loosening of scud in dehaired hides, wherein the use of pancreatin is, to be sure, possible, but is not necessary. It has been found according to the invention that soaked, limed, and dehaired skins and hides can be bated, with the achievement of a fully satisfactory bating effect and with an outstanding loosening of scud, with an enzyme mixture comprising a. an effective amount of a bacterial protease having an optimum effect against hemoglobin at a pH from 10 to 12 and b. an effective amount of a fungus protease whose optimum efficacy toward casein is at a pH greater than 7, a neutral to weakly alkaline bacterial protease, papain, or trypsin (all of which are optimally effective at a pH between 7 and 9), or a mixture of such proteases.

The loosening of scud in the process, as can be seen from the following Examples, is improved in comparison with the loosening of scud obtained with traditional bating agents comprising pancreatin. More intense decomposition of the skin substances does not occur. Surprisingly, finished leather prepared by the use of a bating agent according to the present invention has a more elastic grain and a softer hand than does leather prepared using known bating agents comprising pancreatin. The use of the new bating agent is particularly advantageous for producing leathers that are to have only a minimal surface color treatment. In such leathers, a uniform dye of the leather over its entire surface is particularly desired.

The "strongly alkaline proteases" mentioned under (a) above, their preparation, and their use are described in German patent publication DOS 1,800,508 and in a large number of corresponding patent documents in other countries. As to the use of these proteinases in the beamhouse, the patent merely mentions that they are suitable for the dehairing of hides and skins. German patent publication DOS 1,811,000 teaches the isolation of such proteases, effective in a strongly alkaline region, from the bacterial organism *Bacillus subtilis*, as well as from certain kinds of Streptomyces. According to German patent publication DOS 1,807,185, the *Bacillus alcalophilus* strain also produces proteases whose activity maximum is in the aforementioned pH region of 10–12.

As component (b) of the enzyme mixtures of the invention, the fungus proteases and/or the neutral to weakly alkaline bacterial proteases and/or papain and/or trypsin, or a mixture of these enzymes, can be used together with the aforementioned strongly alkaline proteases. Bacterial proteases of this type include, for example, those formed by Bacillus subtilis of the mesentericus group, by *Bacillus natto*, *Streptomyces griseus*, *Bacillus cereus*, and *Bacillus mycoides*.

Advantageously, the amount of the strongly alkaline proteases (a), expressed in Leohlein-Vollhardt units of enzymatic efficacy, is so chosen that they contribute from 5 to 50 percent of the total enzymatic efficacy of the bating agent. If fungus proteases are employed together with these enzymes, those obtained, as accompanying enzymes, in the form of soluble enzyme complexes together with amylase, cellulase, and various glycosidases, from Aspergillus cultures, particularly from cultures of *Aspergillus niger* or *Aspergillus flavus*, are advantageously used.

The total effective amount of enzyme employed may vary over wide limits depending on the nature of the skins and hides being treated, the enzyme combinations employed, the speed with which the bating is to be effected, etc. In general, the amount of enzymes employed should be such as to contribute between 0.3 to 6.5 percent of the weight of the skins or hides being treated of an enzyme with an enzymatic efficacy of 1000 LVU.

More particular, the following amounts of enzymes of types (a) and (b) (1000 LVU) are preferably employed:

| Skins or Hides of | Proteinases (a) and (b) of 1000 LVU, (%) | Bating process | |
|---|---|---|---|
| | | time (minutes) | temperature (°C) |
| calf | 0.3 – 1.0 | 15 – 60 | 25 – 32 |
| cow | 0.4 – 2.0 | 20 – 120 | 28 – 32 |
| goat | 1.0 – 6.5 | 30 – 300 | 30 – 32 |
| sheep | 0.3 – 0.8 | 50 – 90 | 25 – 32 |
| pig | 1.0 – 5.0 | 30 – 300 | 28 – 35 |

Conventionally, the proteolytic efficacy of enzymes is principally determined according to the Anson hemoglobin method or by the Loehlein-Vollhardt method involving the hydrolytic decomposition of casein. An Anson unit (ASU) is that amount of enzyme which decomposes hemoglobin under certain standard conditions with such an initial velocity that such an amount of decomposition products, not precipitable with trichloroacetic acid, is released per minute as gives the same color intensity with phenol reagent as does one milliequivalent of tyrosine. The Loehlein-Vollhardt unit (LVU) is that amount of enzyme which hydrolyzes 1.725 mg of casein under the test conditions prescribed for this method.

For convenience in dosing, the enzymes are frequently combined with sodium sulfate prior to addition to the bating bath.

It should be emphasized that none of the proteolytic enzymes mentioned under (a) or (b), nor any mixture of the (b) enzymes, gives a loosening of scud and bating effects comparable with those of the agents according to the present invention unless the enzymes are employed together with a predominant amount of pancreatic trypsin. It has already been mentioned that the enzyme mixture according to the present invention has certain advantages, from the point of view of the loosening of scud and the quality of the finished leather, in comparison with bating agents comprising pancreatin.

The significance of the new process, as has been mentioned earlier while characterizing the present state of the art, lies primarily in the replacement of pancreatic trypsin by an enzyme mixture whose components, to the extent they are of microbiological origin, can be produced in any desired amounts. The inclusion of trypsin among the enzymes mentioned under (b) as part of the present invention is to prevent imitation of the present invention by a partial replacement of the trypsin in conventional agents by a protease of the type (a) described above. Nevertheless, in every case the process of the present invention can be carried out with enzyme mixtures free of trypsin.

The bating process of the present invention is advantageously carried out at a pH from about 7.5 to about 10, preferably from about 7.5 to about 8.5. Since skins which have been limed may have a pH of about 11, it may be suitable to decrease the pH of the bating bath by the addition of an acid or acid salt. For this purpose, acids such as formic, acetic, lactic, glycolic, adipic, sulfophthalic, naphthalene-sulfonic, or citric are used to advantage, as are salts such as ammonium sulfate, ammonium bisulfate, ammonium bisulfite, or sodium acid phosphate.

The additives known in the prior art for use in enzymatic bating processes, such as activators, stabilizers, and bacteriostatic agents, can also be employed in carrying out the process of the present invention.

A better understanding of the present invention and of its many advantages will be had from the following specific Examples, given by way of illustration. In the Examples, the percentages given are by weight of the skins or hides being treated.

EXAMPLE 1

100 Kg of dehaired calf hides are washed for 20 minutes in a paddle, with 400 percent of water at a temperature of 30°C. The bath is then drained off.

The hides are then delimed by stirring them for 20 minutes with:

400 percent of water (30°C.),
0.8 percent of ammonium chloride, and
0.4 percent of sodium bisulfite.

Bating is then effected by adding:

0.0068 percent of alkaline bacterial protease (77,000 LVU) (*Bacillus subtilis*),
0.0035 percent of fungus protease (140,000 LVU) (*Aspergillus oryzae*), and
0.9 percent of ammonium sulfate and agitating for a further 40 minutes.

The pH value in the bath at the beginning of the bating process is 6.0. At the end it is 8.2. The outer third portions of a cross-section of a hide treated with phenolphthalein solution are colorless; the central third is red.

At the end of the bating, the skins are permeable to air and scud and short hairs can be easily removed by rubbing with the hand.

EXAMPLE 2

After fleshing, 100 kg of black-variegated dehaired cow hides are washed for 20 minutes in a drum with 100 percent of water at 30°C.

Deliming and bating are performed over a period of one hour with:

50 percent of water (30°C.),
2 percent of ammonium sulfate,
0.5 percent of sodium bisulfite,
0.0068 percent of alkaline bacterial protease (77,000 LVU) (*Bacillus mesentericus*), and
0.01 percent of papain (50,000 ASU).

During the bating, the pH rises from an initial value of 7.5 to 9.0. 0.3 percent of formic acid, diluted with water in a ratio of 1:10 before addition, is added in two portions separated by a period of 20 minutes to bring the final pH of the bating bath to 8.0.

A cross-section of the hide treated with phenolphthalein solution is colorless.

At the end of the bate, the skins are contracted and exhibit no transparent character as after liming. Using the thumb-pressure test, the intensity of the bating is demonstrated by the persistence of the imprint on the grain.

EXAMPLE 3

100 Kg of dehaired goat skins are first washed in a paddle for 20 minutes with 400 percent of water at 35°C.

Deliming is carried out in the reeling vat in 20 minutes with:

400 percent of water (35°C. initial temperature)
1.5 percent of ammonium sulfate, and
0.5 percent of glycolic acid.

Bating is carried out by then adding:

0.0136 percent of alkaline bacterial protease (77,000 LVU) (*Bacillus subtilis*),
0.005 percent of neutral bacterial protease (100,000 LVU),
0.002 percent trypsin (250,000 LVU), and
1.8 percent of ammonium sulfate.

The duration of bating is 2 hours. The skins are agitated during the entire bating operation. The pH value at the beginning of the bate is 5.5 and is 8.5 at its end.

The hides are delimed throughout and a cross-section shows no red coloration when treated with phenolphthalein.

The hides are permeable to air. Scud can be removed easily by rubbing or wiping.

EXAMPLE 4

100 Kg of dehaired sheepskins are first rinsed in a drum for 20 minutes with water at 28°C. The bath is then discarded.

Deliming and bating are carried out with:

150 percent of water (30°C.),
0.2 percent of ammonium chloride,
0.0034 percent of alkaline bacterial protease (77,000 LVU) (*Bacillus subtilis*), 0.0035 percent of fungus proteinase (140,000 LVU) (*Aspergillus niger*),
0.005 percent papain (50,000 ASU), and
1.5 percent of ammonium sulfate.

The hides are agitated for 20 minutes. After this 20 minute period, the pH value is measured and 0.3 percent of formic acid (technical, 85 percent), diluted with a tenfold amount of water prior to addition, is added.

The total bating time is 40 minutes.

The pH value in the bath at the beginning is 5.5 and is 7.5 at the end.

At the end of the bate, the hides are to a large extent free of scud and dirt, as can be demonstrated by wiping them with the hand. Because of the particularly good loosening of scud, wiping can therefore be omitted.

EXAMPLE 5 (COMPARISON EXAMPLE)

100 Kg of black-variegated dehaired bulls' hides are washed after fleshing in a drum with 100 percent of water at a temperature of 30°C., for 20 minutes.

Deliming and bating are carried out by addition of:
50 percent of water (30°C.),
2 percent of ammonium sulfate,
0.5 percent of sodium bisulfite,
0.006 percent of trypsin (250,000 LVU).

The bating period is 1 hour. In order to achieve a maximum bating effect, the pH value of the solution should be between 7.8 and 8.2. The pH is adjusted with 0.3 percent of formic acid which is diluted prior to addition in a ratio of 1:10 with water. The final pH value of the bating solution is 8.2.

In comparison to the bating processes according to the present invention, as shown in Examples 1–4 herein, 40 percent more enzyme must be employed when trypsin is used in order to achieve the same bating effect.

What is claimed is:

1. A method for bating soaked, limed, dehaired skins and hides which comprises contacting said skins and hides for 15 minutes to 300 minutes with an aqueous bath having a temperature from 25° to 35°C. and a pH between 7.5 and 10, said aqueous bath comprising an enzyme mixture consisting essentially of a. a bacterial protease having an optimum efficacy towards hemoglobin at a pH from 10 to 12, and
b. a fungus protease having an optimum efficacy toward casein at a pH above 7, a neutral to weakly alkaline bacterial protease, papain, trypsin, or a mixture of these proteases, said enzyme mixture being present in an amount equivalent to 0.3 to 6.5 percent, by weight of said skins and hides, of enzymes having an enzymatic activity of 1000 Loehlein-Vollhardt units.

2. A method as in claim 1 wherein the amount of said protease (a) is such that its activity, expressed in Loehlein-Vollhardt units, is from 5 to 50 percent of the total enzymatic activity of the enzyme mixture employed.

* * * * *